US006711751B1

(12) United States Patent
Muskovitz

(10) Patent No.: US 6,711,751 B1
(45) Date of Patent: Mar. 30, 2004

(54) MOUNTING SYSTEM FOR HELMETS

(75) Inventor: David Todd Muskovitz, Park City, UT (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 10/094,945

(22) Filed: Mar. 8, 2002

Related U.S. Application Data

(60) Provisional application No. 60/274,446, filed on Mar. 8, 2001, and provisional application No. 60/274,448, filed on Mar. 8, 2001.

(51) Int. Cl.[7] ..... A42B 1/06

(52) U.S. Cl. ..... 2/410; 2/10; 2/421; 2/422; 2/425

(58) Field of Search ..... 2/410, 10, 425, 2/421, 422, 423, 411, 412, 6.3, 6.7

(56) References Cited

U.S. PATENT DOCUMENTS

| | | | | | |
|---|---|---|---|---|---|
| 2,282,830 | A | * | 5/1942 | Scudder et al. | 2/423 |
| 2,991,478 | A | * | 7/1961 | Zbikowski | 2/421 |
| 3,239,842 | A | * | 3/1966 | Marchello | 2/422 |
| 3,262,125 | A | * | 7/1966 | Bowen | 2/6.7 |
| 3,273,163 | A | * | 9/1966 | Andrews, III | 2/422 |
| 3,497,874 | A | * | 3/1970 | Molitoris | 2/423 |
| 4,179,753 | A | * | 12/1979 | Aronberg et al. | 2/10 |
| 4,398,306 | A | * | 8/1983 | Gooding | 2/421 |
| 4,686,712 | A | * | 8/1987 | Spiva | 2/10 |
| 4,764,989 | A | * | 8/1988 | Bourgeois | 2/422 |
| 5,083,321 | A | * | 1/1992 | Davidsson | 2/421 |
| 5,088,130 | A | * | 2/1992 | Chiarella | 2/411 |
| 5,119,516 | A | * | 6/1992 | Broersma | 2/411 |
| 5,351,341 | A | * | 10/1994 | Broersma | 2/412 |
| 5,598,588 | A | * | 2/1997 | Lee | 2/421 |
| 5,619,756 | A | * | 4/1997 | Garneau | 2/425 |
| 5,940,890 | A | * | 8/1999 | Dallas et al. | 2/421 |
| 5,987,652 | A | * | 11/1999 | Fowler | 2/452 |
| 6,009,562 | A | * | 1/2000 | Bullock et al. | 2/422 |

FOREIGN PATENT DOCUMENTS

| | | | | |
|---|---|---|---|---|
| EP | 291308 A1 | * | 11/1988 | A42B/3/00 |
| FR | 2320066 A | * | 4/1977 | A42B/3/02 |
| WO | WO 9113560 A1 | * | 9/1991 | A24B/3/08 |
| WO | WO 9305672 a1 | * | 4/1993 | |
| WO | WO 8604791 a1 | * | 8/1996 | |

OTHER PUBLICATIONS

"Titan Carbon," *Ovo Helmets*, 2001, <http://www.ovousa.com/titan.htm> [retrieved Jun. 7, 2002].

* cited by examiner

*Primary Examiner*—Rodney M. Lindsey
(74) *Attorney, Agent, or Firm*—Christensen O'Connor Johnson Kindness PLLC

(57) ABSTRACT

The present invention is directed to a helmet which includes a shell portion, a liner portion which is in the interior part of the helmet, and an insert portion which is embedded in the liner portion. The insert portion includes a mounting portion for one or more accessories, such as chin straps, side flaps, padding, and the like. The mounting liner provides structural integrity to the protective helmet, provides sufficient impact attenuation properties, and allows various items to be attached to the protective helmet, while still allowing the outer shell to be of lightweight construction. In one aspect, side portions about the ear are coupled to the insert portion. The side portions are rigid to provide support for side eyewear retaining portions that hold an eyewear elastic portion at the side of the helmet, thus preventing the eyewear from sliding off while resting atop the helmet.

50 Claims, 5 Drawing Sheets

MOUNTING SYSTEM FOR HELMETS

CROSS-REFERENCE TO RELATED APPLICATIONS

This application claims the benefit of Provisional U.S. Application Nos. 60/274,446 and 60/274,448, both filed on Mar. 8, 2001.

FIELD OF THE INVENTION

The present invention relates to helmets. Specifically, the present invention relates to helmets having means of retaining eyewear, such as goggles, to the helmet.

BACKGROUND OF THE INVENTION

Helmets can be bulky and unattractive. This is largely due to the intended functionality of helmets. There are two main components to a helmet—the outer shell, and the inner liner. The inner liner, which commonly is made from foam, provides impact attenuation.

Prior art helmets are equipped with a thick outer shell. The shell is constructed to be able to support many of the attachments that accompany a protective helmet, such as straps, ear protectors, padding, ventilation systems, etc. While it is desirable to construct as light a helmet as possible without sacrificing structural integrity, many prior art helmets require a thick outer shell to withstand the various attachments to the helmet, as these items are unable to be attached to the inner liner because of its foam composition. Indeed, many prior art liners are composed of material that will not support attachment means such as a rivet or snap or other fasteners, although they provide the necessary impact attenuation properties. As the function of prior art, protective helmets often dictate the form they take, protective helmets are heavy and burdensome.

Other helmets, such as those commonly used for bicycling or skiing, may use a thinner walled shell to reduce the overall weight of the helmet. With thin-shelled helmets, neither the foam liner nor the shell is structurally capable of supporting fasteners, such as rivets or screws, that hold chin straps, ear protectors, and the like. In some helmets, the webbing is passed over apertures created between the liner and shell and the strap runs down the sides of the helmet eventually forming the chin straps. One particular type of helmet is molded in a single operation where a liner is allowed to bond to an exterior shell in a mold. One term used to describe this process and the helmet it produces is "in-mold" or "in-molding". It is believed that in-mold helmets provide superior protection as compared with helmets wherein the interior foam liner is glued or tacked onto the exterior shell. The drawback with thin shell helmets is the lack of support for accessories and a means of fixing them securely to the helmet.

The thicker shell helmets can support rivets and screws on the shell, but they are too heavy. In one aspect, the present invention seeks to fulfill the need to have ways of attaching one or more accessories to the helmet while maintaining a thin shell.

Helmets have become commonplace in many sporting and outdoor activities. In addition, it is often necessary, due to the nature of the activity, for the user of protective helmets to also have a need for eyewear, such as goggles. As such, users of helmets have been forced to wear, simultaneously, both a helmet as well as separate eyewear. Because of the unique shape and often slippery outer surface of a helmet, users have found it difficult to secure the eyewear to the helmet when engaged in sporting or outdoor activities.

Prior art devices exist that have attempted to provide means of retaining the protective eyewear to the helmet to prevent the eyewear from slipping off while in use. One such device is a retaining means attached to the rear of the helmet. The retaining means located at the rear of the helmet serves to fasten the elastic band of the eyewear to the helmet, thus reducing the potential for the eyewear to become separated from the helmet. However, a retaining means of this type is limited in its usefulness by its location at the rear of the helmet. For example, eyewear is often temporarily removed and slid upwardly from the eyes to a position resting on top of the helmet. Using a retaining means attached to the rear of the helmet does not prevent the goggles from slipping back from their position on the front of the helmet to the rear of the helmet and ultimately, off of the helmet, only to dangle from the rear of the helmet by the retaining means attached thereto. Also, having a retaining means located at the back of the helmet exerts a force on the eyewear tending to pull the eyewear off the helmet. Moreover, because of the competitive nature of many sporting events, or even a desire to have and wear smaller, lighter helmets, athletes and other users will often purchase what is called a short "shell helmet". Short-shell helmets are lightweight and have a low profile compared with regular scale helmets. Short-shell helmets have a portion removed or cut away above the ear. As such, the eyewear retaining means is often placed on the rear of the helmet for lack of an alternative location. In another aspect, the present invention seeks to fulfill the need to have a means of retaining eyewear to helmets.

SUMMARY OF THE INVENTION

The present invention is directed to a helmet which includes a shell portion, a liner portion which is in the interior part of the helmet, and a means in the liner for mounting one or more accessories on the helmet. In one embodiment the means includes an insert portion which is embedded in the liner portion, wherein the insert portion includes a place for mounting one or more accessories, such as chin straps, side flaps, padding, and the like.

In one particular embodiment, the multiple mounting portion of the insert includes an aperture, wherein a fastener can be mounted through the aperture. In one instance, the fastener can be used to support a chin strap. In one instance, the fastener can protrude through the outer shell giving the appearance and look and feel of a sturdy, thick shelled helmet, all the while being a relatively thin-shelled helmet.

In another particular embodiment, the helmet includes a second fastener mounted to the insert. In one instance, the second fastener is a snap-on fastener, wherein an ear flap or ear padding can also be conveniently fastened to the insert.

In another aspect of the invention, an in-mold helmet is disclosed. The in-mold helmet has a shell portion, a liner portion interior to the shell portion, and an insert portion with a multiple mounting portion and an anchoring portion embedded in the foam liner. The anchoring portion includes an arcuate member with a surface being aligned against the inner liner, so as to resist being pulled from the liner. The arcuate member is connected to the mounting portion of the insert by one or more members.

In one particular embodiment, a helmet includes four insert portions, one at each quadrant of the helmet. Each insert has a multiple mounting portion with a fastener for a chin strap, wherein a portion of the fastener protrudes through the exterior shell. Each insert has a second fastener for coupling to a second accessory. In one instance, the second fastener is a snap on fastener and ear padding is attached to the second fastener.

In another aspect of the invention, a helmet liner insert is provided. The insert is made to be lightweight, yet sturdy enough to support one or more accessories. To this end, the insert includes a multiple mounting portion and an anchoring portion. The anchoring portion includes a arcuate member having a surface aligned against the inner liner. The arcuate member is connected to the mounting portion by one or more members. The insert can suitably be made by an injection molding process from plastics.

In another aspect of the invention, a method for making a helmet is disclosed that includes placing an insert with a multiple mounting portion and an anchoring portion in the helmet liner.

In another aspect of the present invention, a method for making an in-mold helmet is provided. The method includes placing an insert having a multiple mounting portion and an anchoring portion in a mold where the shell is located and then forming the liner. In this manner, at least an anchoring portion is embedded in the liner. The anchoring portion secures the insert to the helmet. The multiple mounting portion serves to attach one or more accessories to the helmet.

In one embodiment, the present invention provides a protective helmet comprising an outer shell portion, a liner portion interior to the shell portion and attached thereto, and a means for attaching one or more accessories to the helmet. In one actual embodiment, four injection molded rigid plastic inserts, each having means for mounting one or more accessories to the helmet, are used in a helmet. The inserts have mounting and anchoring portions. The anchoring portions are in the liner portion. Two inserts are provided on either side of the helmet.

The helmet according to the present invention provides numerous advantages over existing helmets. For example, a fastener in the insert can be allowed to protrude through the shell. The fastener, in addition to being used to hold one or more accessories, also provides structural integrity to the helmet by connecting the shell to the liner. The helmet according to the invention provides sufficient impact attenuation properties, and allows various items, such as straps or other accessories, to be attached to the protective helmet, while still allowing the outer shell to be of lightweight construction. The outer shell is allowed to be of more lightweight construction, as it is not required to support attached items. The insert allows releasable parts like straps, ear protectors, pads, webbing, ventilation ducts, and other items to be coupled to the helmet via the insert. The insert is even capable of providing the necessary support for rivets, snaps, and other like attachment means.

In one particular embodiment, the insert according to the present invention can be used to provide an eyewear retaining portion located on the side of the helmet. The retaining portion retains the eyewear from the top and bottom.

Accordingly, the present invention is also directed to a helmet, including a shell portion, a liner portion interior to the shell portion, and means for retaining eyewear on the side of a helmet, wherein the means retain the eyewear from the top and bottom.

In one embodiment, the helmet according to the present invention includes two eyewear retaining portions, each located on either side of the helmet.

In one embodiment, the helmet according to the present invention includes a shell portion, a liner portion interior to the shell portion, and an insert portion in the liner. A side portion can be attached to the insert portion, and an eyewear retaining portion can be attached to the side portion. The eyewear retaining portion is also attached to the helmet shell at a second end.

In one particular embodiment, the retaining portion is a strap. The strap is attached to the side portion, and the opposite end is releasable, allowing the placement of eyewear elastic bands.

In another aspect of the present invention, a method for making a helmet is disclosed. The method of making a helmet includes placing an eyewear retaining portion on the side of the helmet. The retaining portion is capable of retaining the eyewear from the top and bottom.

In one particular aspect, the side portions are located on opposing sides of the helmet. The side portions are securely fastened to the helmet via the insert portion. The side portions extend down a sufficient distance. The side portions can be made of plastic or any other material capable of providing rigid support to the eyewear retaining portion.

The present invention provides a protective helmet, either short-shell, in-mold or otherwise, that allows for eyewear retaining means on the side of a helmet. The retaining portions are placed at optimal locations along the protective helmet, including the sides, such that the protective eyewear may be removed and secured in a temporary position.

The side portions of the present invention have many advantages. First, they may be equipped with various pads and/or insulating members to protect the user from outside elements. Second, they provide a mounting location for the eyewear retaining portions that are used to secure eyewear to the side of the helmet. The present invention includes side eyewear retaining portions used to secure eyewear to the side of the helmet, rather than in the rear, as in many prior art helmets. The eyewear retaining portions are attached both to the outer shell and to the side portions. In doing so, this provides significant advantages. For example, if eyewear elastic bands are securely fastened to the helmet at the sides, the user can temporarily remove the lens/frame portion and place it on top of the helmet without the lens/frame portion potentially sliding back and falling off of the helmet. Rather, by securing the elastic bands along the sides of the helmet, the tension placed on the lens/frame portion is directed down onto the helmet rather than toward the rear. Subsequently, this keeps the lens/frame portion firmly on the helmet and prevents it from dangling or getting tangled while it is not in use, but merely resting on the helmet. Previous helmets having only a single rear retaining portion do not provide the proper amount of downward pressure on the lens/frame portion to keep it on the helmet. The present invention may, in addition, also use a rear eyewear retaining portion.

BRIEF DESCRIPTION OF THE DRAWINGS

The foregoing aspects and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE PREFERRED EMBODIMENT

It will be readily understood that the components of the present invention, as generally described and illustrated in the figures herein, could be arranged and designed in a wide variety of different configurations. Thus, the following more detailed description of the embodiments of the apparatus and method of the present invention, and represented in FIG. 1, is not intended to limit the scope of the invention, as claimed, but is merely representative of the presently preferred embodiments of the invention.

The presently preferred embodiments of the invention will be best understood by reference to the drawings, wherein like parts are designated by like numerals throughout.

Figure 1:
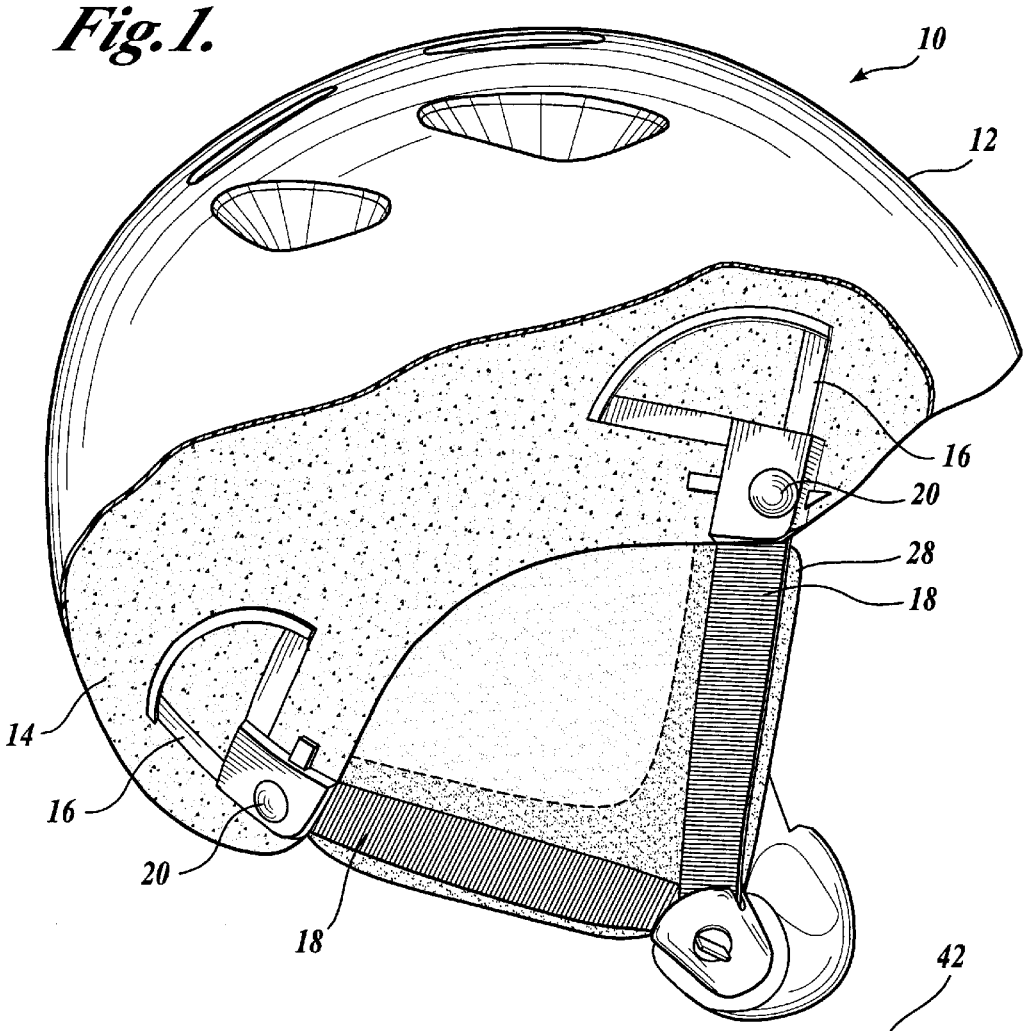
FIG. 1 is a side view illustration of a helmet and insert portion according to the present invention.

Referring now to FIG. 1, a helmet according to the present invention is illustrated. The helmet 10 includes an exterior shell portion 12. Part of the shell portion 12 is removed to show the inserts of the present invention. The shell portion 12 can be made from any suitable material, such as but not limited to plastic materials such as polycarbonate, polyethylene terephthalate, acrylonitrile butadiene styrene, and like materials. In some instances, the exterior shell portion 12 may be less than 0.1 inches thick. However, in other embodiments, the shell portion 12 thickness is less than 0.1 mm. The exterior shell portion 12 may have cutouts for vents, fasteners or for other purposes. In some instances, the shell portion 12 of the present invention can be a "thick" shell helmet greater than or equal to 0.1 inches, particularly in those helmets designated to be used for motorcycle driving. Methods for making the shell portion 12 are well known.

Referring again to FIG. 1, the helmet according to the present invention includes a liner portion 14. The liner portion 14 is attached to the shell portion 12. The liner portion 14 has impact attenuation properties and is most commonly made of a foamed plastic material. In some instances, the liner portion 14 can be glued on or taped to the interior the shell portion 12. However, in other instances, the liner portion 14 is bonded directly to the shell by utilizing the in-mold method. The in-mold process begins by placing a thin piece of plastic, i.e., the exterior shell, in a mold. The shell conforms to the inner surface of the mold. Additional parts, such as the insert 16, are located at their proper position on the helmet. The mold is then sealed and polystyrene, in one form or another, is then added to the mold to lie atop the shell. The mold is then sealed. The mold with shell and inserts is then injected with steam under pressure. The heat provided by the steam causes the polystyrene to expand, forming the liner along the shell and fixing the inserts in the liner. The in-mold process can produce a helmet with increased strength as compared to other helmets where the liner is simply glued to the shell. The fusing of the expanded polystyrene (EPS) foam liner and the plastic shell give the helmet greater resistance to cracking or separating on impact. Reference is made to the Bicycle Helmet Safety Institute website at www.bhsi.org/molded.htm from where the foregoing description of the in-mold process in relation thereto is provided. The thickness of the shell portion 12 and liner portion 14 can be adjusted to meet the regulated safety standards for helmets of the particular country.

In some instances, there can be one or more materials interposed between the exterior shell portion 12 and the interior liner portion 14. It will be appreciated that the liner portion 14 can rest directly on a user's head, or that webbing, padding, and the like can be incorporated into the helmet between the liner portion 12 and the user of the helmet.

Referring again to FIG. 1, the helmet 10 includes an insert portion 16 where portions of the insert portion 16 are embedded in the liner portion 14. In some instances, the insert portion 16 can be adjacent to the shell portion 12. In other instances, parts of the insert portion 16 can be partially embedded in the liner portion 14. However, the amount to which the insert portion 16 is covered by the liner portion 14 can vary, including being wholly covered by the liner portion 14. In one embodiment with four inserts, a first insert portion 16 is provided in the anterior right quadrant of a helmet 10, a second insert portion 16 is provided in the posterior right quadrant of a helmet 10. It is to be appreciated that the opposite side of the helmet 10 is of a substantially similar construction and, therefore, a third insert (not shown) is provided in the anterior left quadrant of the helmet 10, and a fourth insert (not shown) is provided in the posterior left quadrant of the helmet 10. Each insert portion 16 has a mounting portion and an anchoring portion, which will be described more fully below.

In one instance, each insert is being used to anchor the ends of a strap 18 and padding 28. It should be recognized by those skilled in the art that one or more inserts can be provided in the helmet 10, or alternatively a single insert unit with a plurality of mounting portions can be used for mounting accessories thereon. For example, a single insert can have a mounting portion, respectively at the anterior left and right quadrants and the posterior left and right quadrants for any number of fasteners wherein the four mounting portions can attach to one or more fasteners. Alternatively, two mounting portions at opposite sides of the helmet can be used, or two inserts with two or more mounting portions can be used. If two inserts are used, they can be positioned at the left and right sides of the helmet or, alternatively, anteriorly and posteriorly on the helmet. In one method of making a helmet according to the present invention, an insert portion having an anchoring portion and a mounting portion is placed in the liner portion of the helmet.

In one method of making an in-mold helmet according to the present invention, an insert portion with a mounting portion and an anchoring portion is placed in a mold containing a shell portion and then the liner is formed, thus embedding the anchoring portion of the insert portion within the liner portion in a single processing step.

Referring again to FIG. 1, the insert portion 16 provides a mounting location for fastener 20, to which a strap 18 and padding 28 can be attached thereto. In one particular embodiment, one end of fastener 20 can protrude through the shell portion 12, the fastener 20 has a flat head to more securely hold the shell portion 12 to the liner portion 14; thus, adding structural strength to the overall shell and liner construction.

Figure 2:
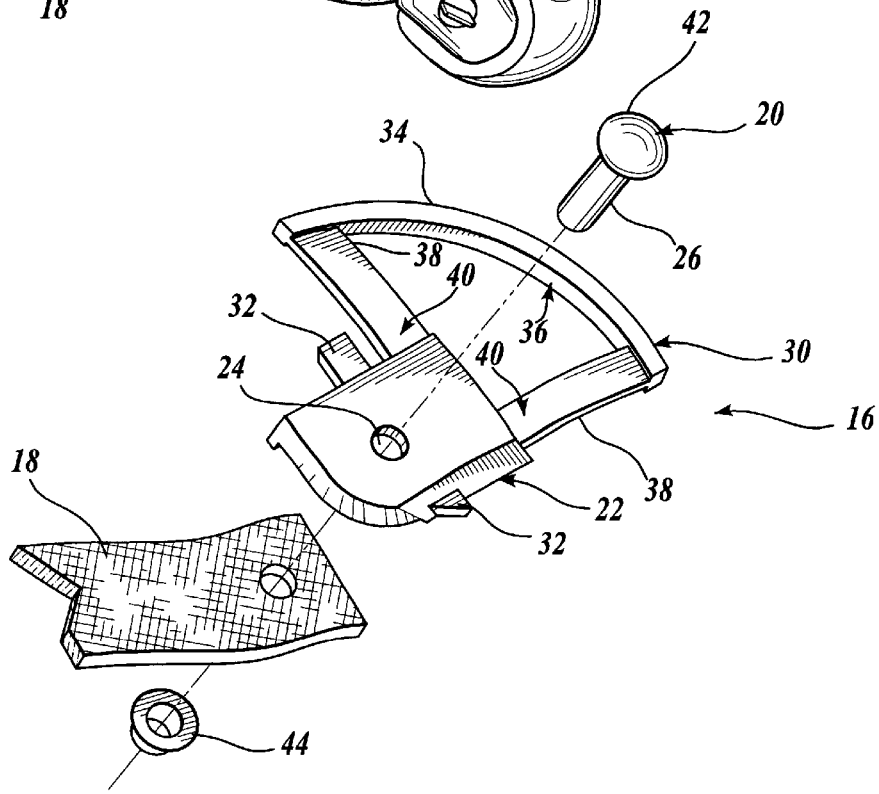
FIG. 2 is an isometric illustration of an insert portion and first and second fasteners according to the present invention.

Referring now to FIG. 2, one embodiment of an insert portion 16 according to the present invention is illustrated. The insert portion 16 can be made of any suitable plastic material, such as nylon. However, it can be readily appreciated that any material which can provide structural support for various accessories can be used, including metals. The insert portion 16 according to the present invention includes a mounting portion 22 on one side thereof and an anchoring portion 30 on a second side thereof. In some instances, one or more edges or surfaces of the mounting portion 22 are shaped to conform to the curves and edges of helmet 10. The overall shape of insert portion 16 can also be curved to follow the curved lines of helmet 10. The mounting portion 22 is of suitable thickness for the intended function. The mounting portion 22 can have buttress members 32 which increase the mounting portion's resistance to lateral movement. Because, in some instances, most of mounting portion 22 may be uncovered for user access, buttress members 32 provide for lateral support. In one particular aspect, the mounting portion 22 includes an aperture 24 for securement of any suitable fastener, such as the fastener 20. However, other suitable fasteners can be envisioned, such as, but not limited to, rivets, screws, bolts, snap-on fasteners, pins, hook and loop fasteners (i.e., VELCRO), and the like. The mounting portion 22 can accommodate one or more fasteners for one or more accessories as will be described below. The mounting portion 22 of the insert portion 16 is located proximate to a lower edge of the helmet, and is accessible from the interior to secure one of the herein described accessories. It is to be appreciated that mounting portion 22 is intended to provide mounting locations for one or more accessories, i.e. and therefore it is a "multiple" mounting portion. One aspect of the invention, is that such accessories are releasable by the user, thus in practice, mounting portion 22 can be absent of such accessories, or it can have one or more accessories mounted thereon. However, in other instances, the accessories attached to the mounting portion 22 are not intended to be releasable by the user. The present invention uses a mounting portion 22 that can support multiple accessories, for example, hanging accessories and riveted, bolted, or screwed accessories, thus making it a multiple mounting portion.

Referring still to FIG. 2, the insert portion 16 includes an anchor portion 30. In one particular embodiment, the anchor portion 30 includes a arcuate member 34. The arcuate member 34 may have a flat surface 36, wherein the flat surface 36 is generally oriented against the liner portion 14 of FIG. 1 or in a manner that makes it difficult to pull out from the liner portion 14. This can be perpendicular to the liner portion 14. In this manner, the anchor portion 30 resists being moved in the direction of the tension being applied on any part of the insert 16. The flat surface 36 of the arcuate member 34 will provide resistance against being moved in a downward direction as chin straps generally apply tension in the downward direction. The anchor portion 30 is embedded within the liner portion 14, while some or all of the mounting portion 22 is accessible to a user of the helmet to be able to mount accessories. The arcuate member 34 is connected to the mounting portion 22 by one or more connecting members 38. In one instance, connecting members 38 may be with flat surfaces 40 that run in the direction of the liner portion 14. In this manner, the mounting portion 22 resists being moved in a generally sideways direction. This is advantageous because chin straps, in addition to applying downward tension, can also apply a generally sideways force. The flat surfaces 40 of connecting members 38 resist from being moved sideways, traversely across the liner. It is to be appreciated that while one example of anchoring portion 30 has been shown, the present invention is not limited thereby. Other suitable anchoring portions are considered to be within the scope of this disclosure.

The mounting portion 22, according to the present invention, can accommodate one or more fasteners for attaching one or a plurality of accessories such as chin straps, ear protectors, padding and the like. In one particular embodiment, a fastener 20, such as a rivet, is provided within aperture 24. The fastener head 42 is exterior of the shell portion 12. The fastener 20 can anchor one end of a strap 18. Opposite of the fastener head 42, a snap fastener 44 can be secured thereto. In one particular embodiment, the snap fastener 44 is provided in the interior of the helmet 10. A cutout (not shown) can be provided in the liner portion 14 to provide access to the snap fastener 44 from the inside of helmet 10. Ear padding 28 can include a corresponding snap-on fastener to mate with fastener 44. Ear padding 28 can be removably placed on the second fastener 44, as illustrated in FIG. 1. Accessories, such as a helmet retaining strap, chin strap, ear portions, padding, side portion, side padding, or eyewear retaining portion, can be fastened by fastener 20 or 44 to the mounting portion 22.

One advantage of having a plurality of inserts made in accordance with the present invention is that one-sized inserts allow for placement into helmets of different sizes. In some instances, however, a single insert can be provided for a single helmet. Alternatively, two or more inserts can be provided.

In one method of making an insert according to the invention, the insert can be made by an injection molding process. However, the insert is not limited thereby. One example of a suitable material for the insert is nylon. However, it is to be appreciated that other suitably rigid plastics can be used or, alternatively, metals can also be used; nylon being one example of a suitably rigid plastic material. The insert portion 16 can be placed in a mold with the shell followed by forming the liner on the shell as described above. In this manner, the insert 16 is embedded within the liner during the liner formation process. However, in other instances, the insert can be placed in the liner without utilizing the in-molding method. The liner and insert can then be glued, adhesived, or otherwise fixed to the shell.

In one use of the insert according to the present invention, the insert can be incorporated into liners, such as foam liners of in-mold helmets, short-shell helmets, helmets with shells unable to support fasteners, as well as thick shell helmets having foam liners. In one aspect, a mounting liner is created for helmets of all types.

The use of liner with insert as described provides structural integrity to the protective helmet, provides sufficient impact attenuation properties, and allows various items to be attached to the protective helmet, while still allowing the outer shell to be of lightweight construction or otherwise. As it is desirable to maintain a lightweight construction, the outer shell of the protective helmet of the present invention may be of a more lightweight construction than typical outer shells. This is because the outer shell thickness is not dictated by attachment means.

It should be noted that for the most part, fasteners or attachment means 20 are supported by the rigid plastic insert 14, wherein little or no structural support is provided by outer shell 12, but instead by rigid plastic insert 16.

Figure 3:
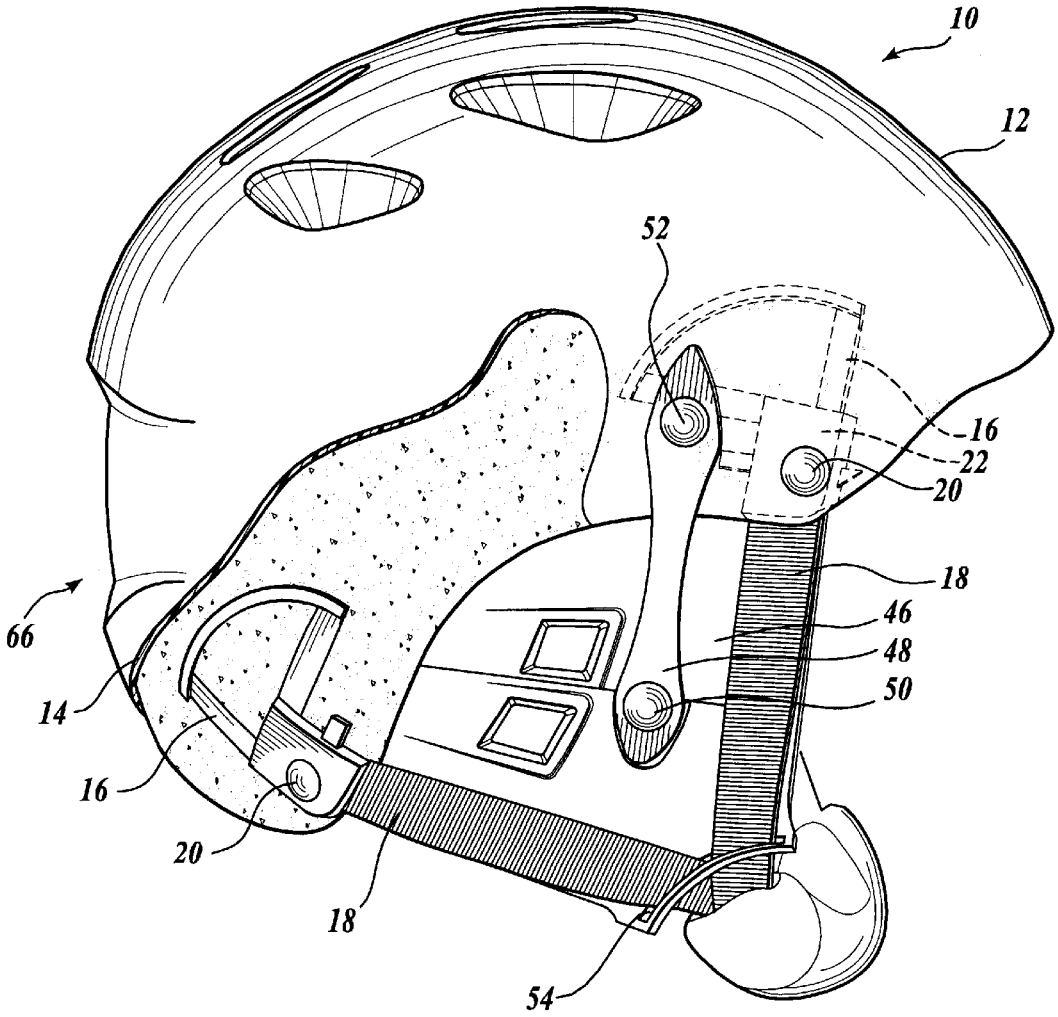
FIG. 3 is a side view illustration of a helmet and side eyewear retaining portion according to the present invention.

Referring now to FIG. 3, an illustration of a helmet 10 according to the present invention is shown. While a short-shell helmet 10 is illustrated, it is to be appreciated that helmet 10 can be any helmet type.

FIG. 3 illustrates one particular use of the insert portion 16 according to the present invention. FIG. 3 illustrates the side portion 46 being attached to the side of helmet 10. Side portion 46 may be of any suitable rigid plastic material, as described above. Side portion 46 supports one end of eyewear retaining portion 48. Eyewear retaining portion 48 may be attached to the side portion 46 by fastener 50. Fastener 50 can by any fastening means such as a rivet, screw, or hook and loop fastener, and the like. The opposite end of eyewear retaining portion 48 may includes a second fastener 52, such as a snap-on fastener. A corresponding snap fastener (not shown) is provided on the helmet shell 12. Alternatively the fastener to which fastener 52 mates can be coupled to the front insert 16, by extending the mounting portion 22 to the area of the fastener. Eyewear retaining portion 48 can be released at an upper end or lower end thereof to allow the entry of any suitable eyewear elastic band. Fastener 52 is reattached to the shell portion 12 after placement of the eyewear band. It is to be appreciated that while a single side portion 46 and eyewear retaining portion 48 are shown, the opposite side of helmet 10 is of similar construction.

Figure 4:
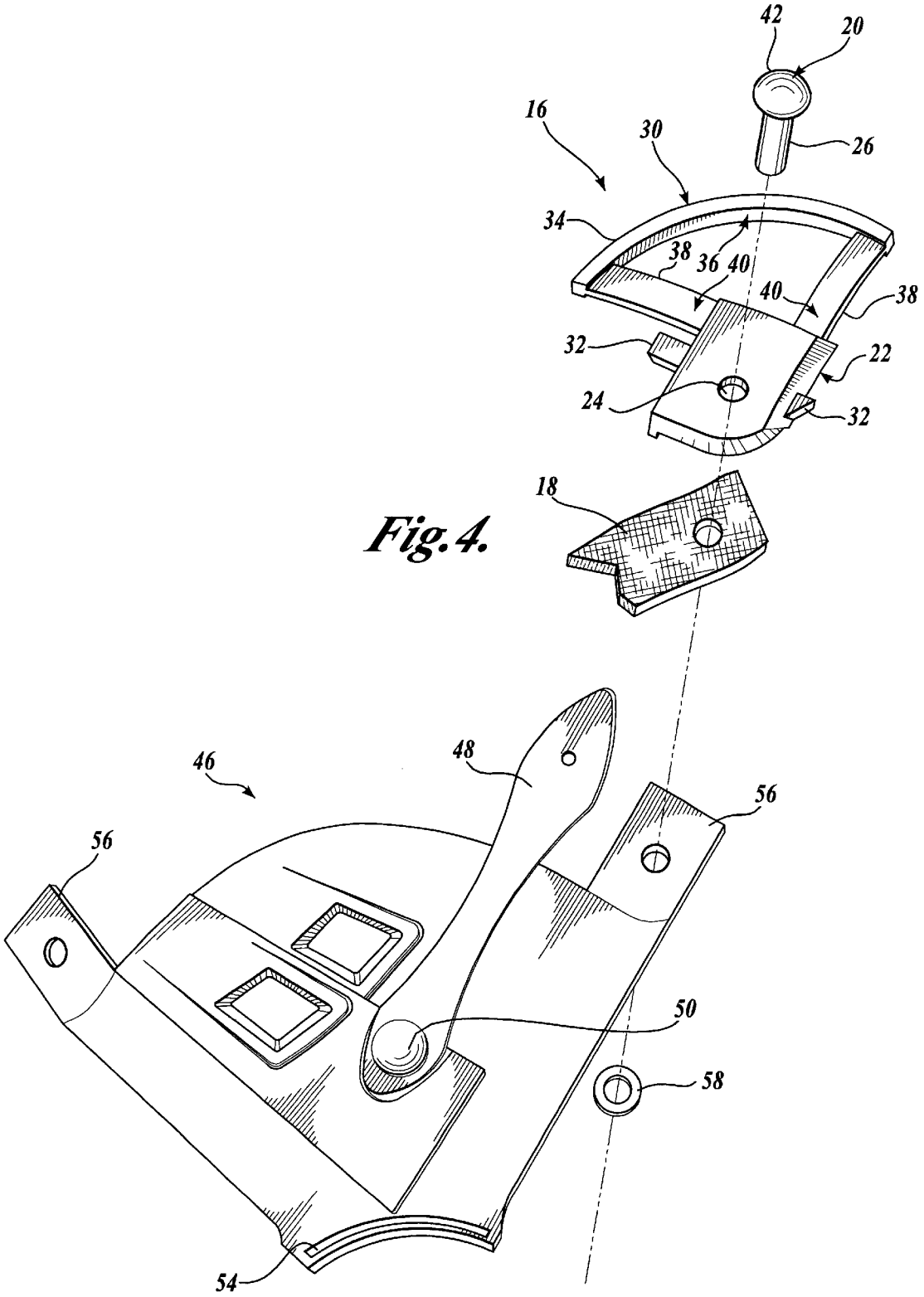
FIG. 4 is an isometric illustration of an insert portion, a side portion, and an eyewear retaining portion according to the present invention.

Referring now to FIG. 3 in conjunction with FIG. 4, an insert portion 16, side portion 46, and an eyewear retaining portion 48 are illustrated. The insert portion 16 has been described above. The side portion 46 may be generally triangular in shape. In one instance, the side portion 46 is constructed to fill the space between the lower arcuate edge of helmet 10 and the straps 18. Side portion can also provide support for straps 18. Side portion 46 may end approximately at the straps 18. Straps 18 can be taped, glued, or otherwise fastened to side portion 46. The side portion 46 may generally look like an inverted triangle, wherein at the apex of the triangle, a slot 54 is provided for receiving the strap portions 18. The base of the triangle may be curved to follow the lower edge of helmet 10 and may be provided with two mounting portions 56 on opposite ends. The mounting portions 56 can be fastened to the two insert portions 16, illustrated in FIG. 3, for example. Fastener 20 passes through aperture 24 in mounting portion 22 of the insert portion 16. Fastener 20 also passes through one end of strap 18. Fastener 20 also passes through one mounting portion 56 of the side portion 46. A retainer 58 secures this assembly of parts to the helmet 10. While insert portion 16, side portion 46, and eyewear retaining portion 48 are shown as separate elements, these elements can be combined to make an integral unit or units.

The side portion 46 may be made of a suitably rigid plastic material, such as nylon. However, it is to be appreciated that other suitably rigid materials can be used, including metals. One method of making the side portion 46 can be an injection molding process. Injection molding processes are well known. One aspect of the side portion 46 according to the invention is its rigidity to provide a mounting location for a side eyewear retaining portion 48.

Referring still to FIG. 4, the eyewear retaining portion 48 according to the present invention is located at the side portion 46. One end of the eyewear retaining portion 48 may be attached to the side portion 46 at about the geometric center of side portion 46. The opposite end of the eyewear retaining portion 48 may be attached to the helmet shell 12 at a relatively forward location on the helmet. Placing an eyewear retaining portion at the above-described location provides a way of holding the visor of the eyewear securely to the shell 12 of the helmet 10. However, this location can deviate either forwards or backwards based on the particular helmet style, while still having the advantage of holding the lens/frame portion on the shell 12. However, if the eyewear retaining portion is positioned too far back or the helmet, the visor will not stay put on top of the helmet 10, for reasons which will be described below. Alternatively, the second end of eyewear retaining portion can also be attached to the insert portion 16.

In one aspect, the eyewear retaining portion 48 may be suitably made from any flexible plastic or similar material. One skilled in the art will recognize the eyewear retaining portion 48 may take on various shapes or forms. In one instance, eyewear retaining portion 48 includes a flexible member connected at its ends to form an enclosed "loop," allowing an elastic band of an eyewear portion to pass therethrough. In one instance, eyewear retaining portion 48 has concave middle sides that widen to receive top and bottom fasteners 50 and 52 and ends in a point. Side eyewear retaining portion 48 can be other shapes that provide retention on top and bottom edges of the eyewear band and may not necessarily be an enclosed loop. Retaining an eyewear portion, such as an elastic band, from the top and bottom edges is advantageous over hanging flaps with an open bottom because retaining the elastic band on the top and bottom equally prevents the lens/frame portion from sliding downwards as well as upwards, whereas hanging flaps open on the bottom do not provide this advantage. However, it is also possible to have only either a top or bottom retainer on the side.

Figure 5:
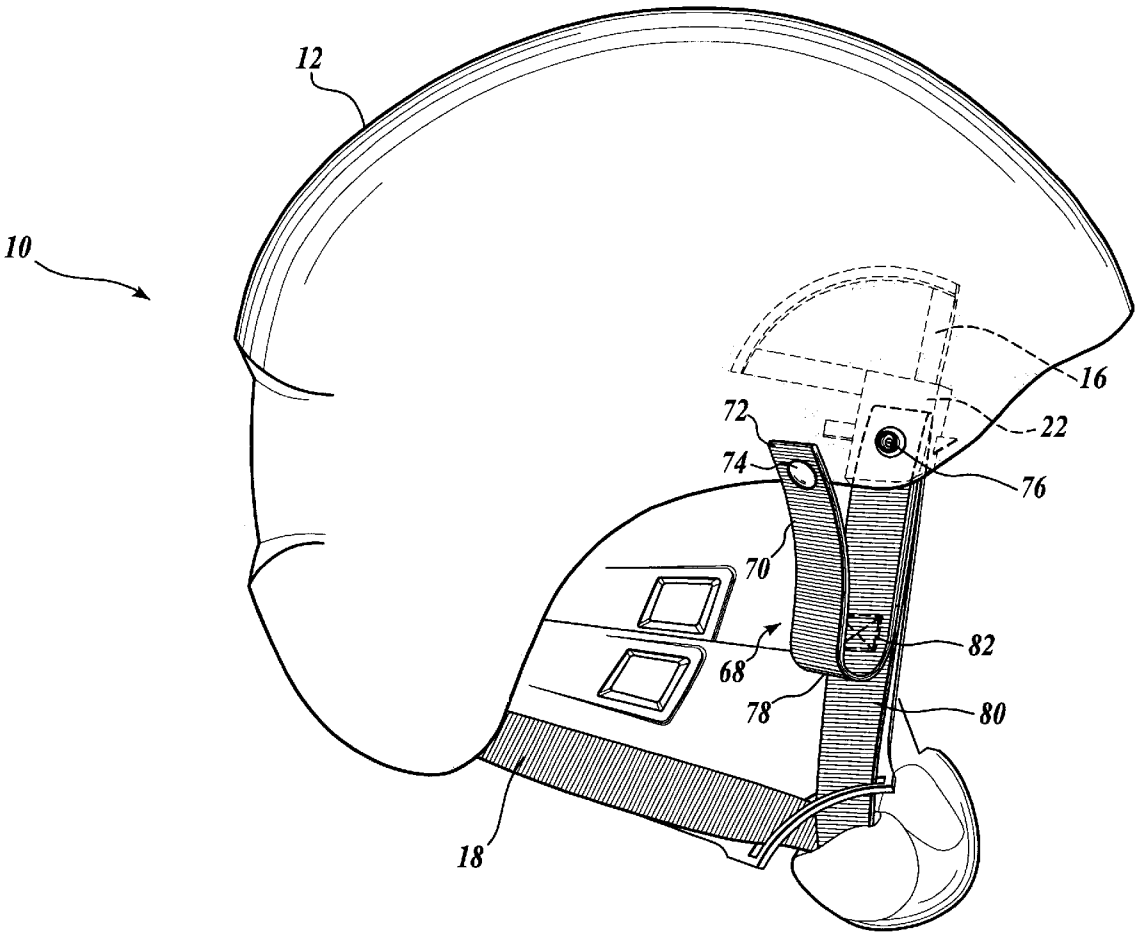
FIG. 5 is an isometric illustration of an insert portion and an eyewear retaining portion according to the present invention.

Referring now to FIG. 5, an alternate embodiment of a side eyewear retaining portion for a helmet is illustrated. Eyewear retaining portion 68 includes a strap portion 70. Strap portion 70 includes a top end 72 with a fastener 74 mounted thereon. In one instance, fastener 74 can be a snap fastener. Fastener 74 mates with a corresponding fastener 76. Fastener 76 is adjacent to the shell 12. In one instance, fastener 76 is attached to the mounting portion 22 of the insert portion 16. In one instance, strap 70 is a flexible woven material, such as nylon. Strap 70 includes a piece of material sufficient to form eyewear retaining portion 68, and may also serve as a chin strap 80, for example. In one instance, strap 70 continues from the top portion 72 to the bottom portion 78. The distance between top portion 72 and bottom portion 78 is sufficient for any suitable eyewear elastic band to be retained therein. The bottom eyewear retaining portion is formed by folding the strap 70. Strap 70 then continues upward from bottom portion 78. Strap 70 can then be fixed at the mounting portion 22. Strap 70 is doubled over and fastened to the mounting portion 22. Thus, strap 70 forms a loop which can retain an eyewear portion, such as an elastic band. In one instance, strap 70 can continue downwards from the mounting portion 22, thus forming a chin strap portion 80. The bottom 78 of the eyewear retaining portion 68 can be stitched to the chin strap portion 80 at location 82. In one instance, strap 70 is a unitary piece from the top end 72 of the eyewear retaining portion 68 to the chin strap portion 80.

Figure 6:
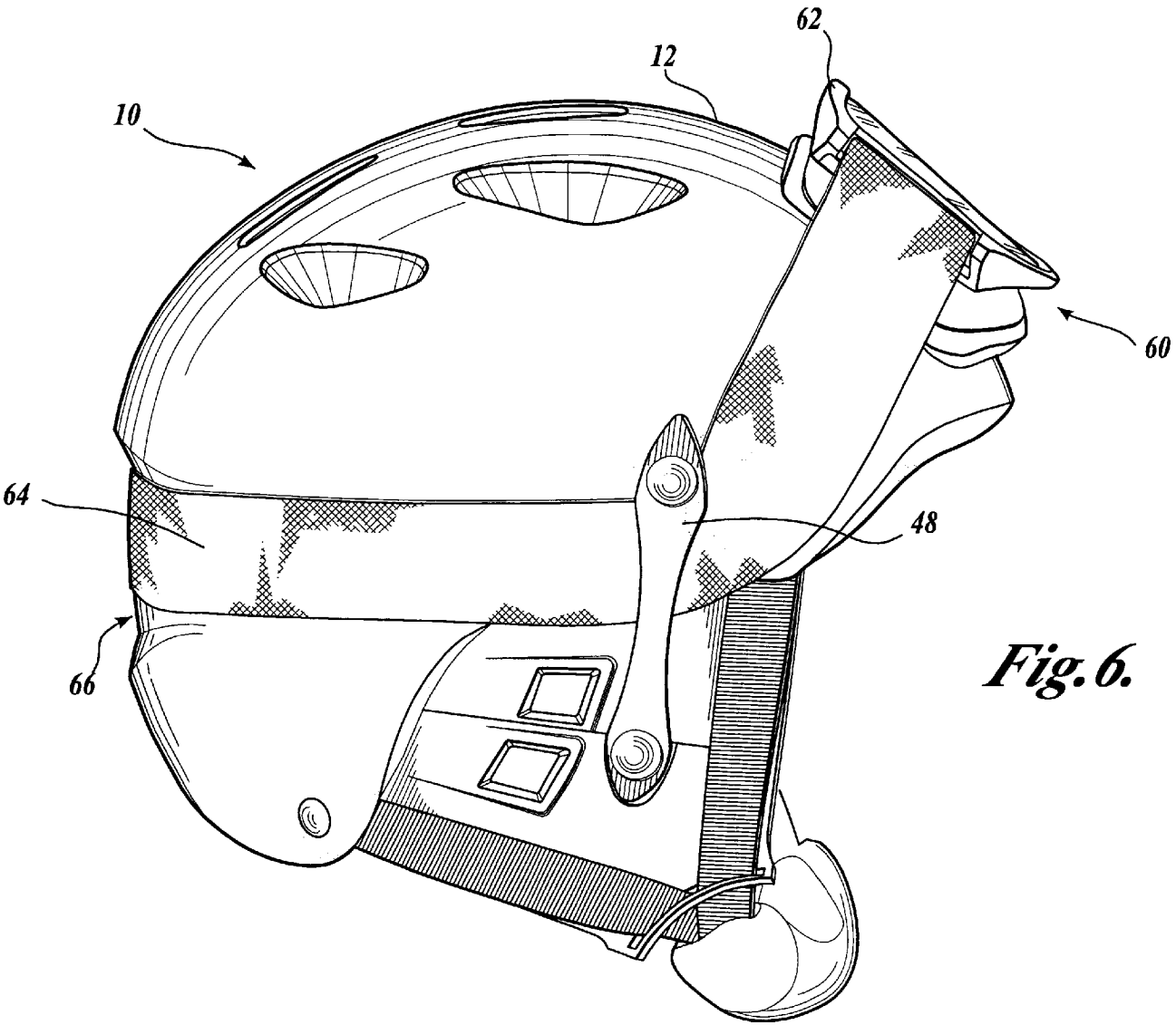
FIG. 6 is a side view illustration of a helmet according to the present invention in use.

Referring now to FIG. 6, a side view illustration of the helmet 10 according to the present invention in use is illustrated. Helmet 10 is shown in use with an eyewear portion 60 having a lens/frame portion 62 and an elastic band portion 64, wherein the lens/frame portion 62 is resting on top of the forward portion of helmet 10. Elastic band portion 64 wraps around helmet rear groove 66, passes through eyewear retaining portion 48 and is attached to lens/frame portion 62 on opposite ends thereof. The angle of elevation of lens/frame portion 62 is multiplied by having a side eyewear retaining portion 48 where shown. In general terms, the angle of elevation is the angle, as measured with respect to a horizontal plane, created between the horizontal plane and a line passing through the eyewear retaining portion and an object (the lens/frame portion) whose angular elevation is to be determined. Also important to the discussion, but by no means limiting of the scope of the claims or intending to be bound by theory, is statics, the study of bodies in equilibrium. A basic concept to understanding static forces is vector analysis. A force vector can be viewed as having a horizontal component and a vertical component. The present invention solves the problem of keeping eyewear on top of helmets. In simple terms, for any set of conditions (i.e., friction coefficient, elastic coefficient, helmet configuration, materials, etc.), the lens/frame portion 62 will slide from the helmet 10 when the combined forces in the upward vertical direction exceed the combined forces in the downward vertical direction. In actual use, meaning that when the lens/frame portion is worn by a user on the face, the angle of elevation of the lens/frame portion 62 will be about 0 degrees, and the elastic force generally has a large horizontal component and a small vertical component, i.e., the elastic band 64 pulls the lens/frame portion 62 into the face. However, when the lens/frame portion 62 is removed and placed atop the helmet 10 according to the present invention, the placement of eyewear retaining portions 48 at the sides of the helmet 10 creates a sharp angle of elevation of the lens/frame portion 62. In doing so, the elastic force now has a large vertical component downward and small horizontal component backwards, meaning most of the force exerted by the elastic bands 64 presses the lens/frame portion 62 firmly down onto the helmet 10. Consider now, if the side eyewear retaining portions 48 were absent, or only a single one is present at the rear of the helmet. All other things being equal, the angle of elevation of the lens/frame portion would be drastically reduced and, therefore, the force exerted by the elastic bands has a much greater horizontal component backwards and a small vertical component downward, which is insufficient to prevent the lens/frame portion from sliding up, considering the helmet angle and, consequently, the lens/frame portion dangles freely.

By retaining elastic bands at the sides of the helmet, many of the problems associated with retaining the bands at the rear of helmets may be eliminated. For example, the eyewear may be temporarily removed while the user is still wearing the helmet by placing the eyewear on top of the helmet or sliding them off the eyes and allowing them to rest on top of the helmet. In doing so, the further forward the eyewear retaining portion is placed on the helmet 10, the greater the stability of the eyewear in their resting position.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed is:

1. A helmet, comprising:

(a) a shell portion;

(b) a liner portion interior to the shell portion; and (c) an entire insert portion in each quadrant of the helmet, wherein each insert portion is in the liner portion, and wherein each insert portion includes a multiple mounting portion.

2. The helmet of claim 1, further comprising a first fastener mounted at the mounting portion.

3. The helmet of claim 2, wherein the first fastener is selected from one of a rivet, screw, bolt, pin, snap, and hook and loop fastener.

4. The helmet of claim 2, wherein one of a helmet retainer strap, chinstrap, ear portion, ear padding, side portion, side padding, and eyewear retaining portion is fastened by the first fastener.

5. The helmet of claim 2, wherein the first fastener protrudes through the shell portion.

6. The helmet of claim 2, further comprising a second fastener mounted at the mounting portion.

7. The helmet of claim 6, wherein the second fastener is selected from one of a rivet, screw, bolt, pin, snap, and hook and loop fastener.

8. The helmet of claim 6, wherein one of a helmet retainer strap, chin strap, ear portion, ear padding, side portion, side padding, and eyewear retaining portion is fastened by the second fastener.

9. The helmet of claim 1, wherein the insert portion further comprises an anchoring portion.

10. The helmet of claim 9, wherein the anchoring portion further comprises a member with a surface disposed against the liner, wherein the anchoring portion is connected to the mounting portion.

11. The helmet of claim 1, wherein the thickness of the shell is less than 0.1 inch.

12. The helmet of claim 1, wherein the thickness of the shell is less than 0.1 mm.

13. The helmet of claim 1, further comprising a plurality of inserts, at least one insert at each helmet side.

14. The helmet of claim 1, having a single insert in the liner, wherein the insert comprises a plurality of mounting portions, the mounting portions located at each helmet side.

15. An in-mold helmet, comprising:

(a) a shell portion;

(b) a liner portion interior to the shell portion; and (c) an entire insert portion in each quadrant of the helmet, wherein each insert portion is in the liner portion, and wherein each insert portion includes a multiple mounting portion.

16. The in-mold helmet of claim 15, further comprising a first fastener mounted at the mounting portion.

17. The in-mold helmet of claim 16, wherein the first fastener is selected from one of a rivet, screw, bolt, pin, snap, and hook and loop fastener.

18. The in-mold helmet of claim 16, wherein one of a helmet retainer strap, chin strap, ear portion, ear padding, side portion, side padding, and eyewear retaining portion is fastened by the first fastener.

19. The in-mold helmet of claim 16, wherein the first fastener protrudes through the shell portion.

20. The in-mold helmet of claim 16, further comprising a second fastener mounted at the mounting portion.

21. The in-mold helmet of claim 20, wherein the second fastener is selected from one of a rivet, screw, bolt, pin, snap, and hook and loop fastener.

22. The in-mold helmet of claim 20, wherein one of a helmet retaining strap, chin strap, ear portion, ear padding, side portion, side padding, and eyewear retaining portion is fastened by the second fastener.

23. The in-mold helmet of claim 15, wherein the insert portion further comprises an anchoring portion.

24. The in-mold helmet of claim 23, wherein the anchoring portion further comprises a member with a surface disposed against the liner, wherein the anchoring portion is connected to the mounting portion.

25. The in-mold helmet of claim 15, wherein the thickness of the shell is less than 0.1 inch.

26. The in-mold helmet of claim 15, wherein the thickness of the shell is less than 0.1 mm.

27. The in-mold helmet of claim 15, further comprising a plurality of inserts, at least one insert at each helmet side.

28. The in-mold helmet of claim 15, having a single insert in the liner, wherein the insert comprises a plurality of mounting portions, the mounting portions located at each helmet side.

29. A method for making a helmet, comprising:

placing an entire insert with a multiple mounting portion and an anchoring portion in each quadrant in a liner of the helmet.

30. A helmet, comprising:

(a) a shell portion;

(b) a liner portion interior to the shell portion; and (c) means for retaining an eyewear elastic band portion from the top and bottom edges of the eyewear elastic band portion, wherein the means are placed on the side of the helmet.

31. A helmet, comprising:

(a) a shell portion;

(b) a liner portion interior to the shell portion; and (c) an eyewear retaining portion configured to retain an eyewear elastic band portion from the top and bottom edges of the eyewear elastic band portion, wherein the retaining portion is located on a side of the helmet.

32. The helmet of claim 31, further comprising a second eyewear retaining portion located on the side opposite of the first retaining portion.

33. The helmet of claim 32, further comprising a side portion for attaching the eyewear retaining portion.

34. The helmet of claim 33, further comprising an insert portion in the liner portion, wherein the side portion is attached to the insert portion.

35. The helmet of claim 31, wherein the retaining portion is attached at first and second locations.

36. The helmet of claim 35, wherein the retaining portion is releasable at least at one of the first and second locations.

37. The helmet of claim 31, having no more than two eyewear retaining portions, one on either side of the helmet.

38. The helmet of claim 31, wherein the retaining portion is closable into a loop.

39. The helmet of claim 31, further comprising a unitary eyewear retaining portion and helmet retaining portion.

40. A short-shell helmet, comprising:

(a) a shell portion;

(b) a liner portion interior to the shell portion; and (c) an eyewear retaining portion configured to retain an eyewear elastic band portion from the top and bottom edges of the eyewear elastic band wherein the retaining portion is located on a side of the helmet.

41. The short-shell helmet of claim 40, further comprising a second eyewear retaining portion located on the side opposite of the first retaining portion.

42. The short-shell helmet of claim 41, further comprising a side portion for attaching the eyewear retaining portion.

43. The short-shell helmet of claim 42, further comprising an insert portion in the liner portion, wherein the side portion is attached to the insert portion.

44. The short-shell helmet of claim 40, wherein the retaining portion is attached at first and second locations.

45. The short-shell helmet of claim 44, wherein the retaining portion is releasable at least at one of the first and second locations.

46. The short-shell helmet of claim 40, having no more than two eyewear retaining portions, one on either side of the helmet.

47. The helmet of claim 40, wherein the retaining portion is closable into a loop.

48. The helmet of claim 40, further comprising a unitary eyewear retaining portion and helmet retaining portion.

49. A method for making a helmet, comprising placing a top and bottom edge eyewear elastic band retaining portion on a side of the helmet.

50. A method for making a short-shell helmet comprising placing a top and bottom edge eyewear elastic band retaining portion on a side portion on a side of a helmet.

* * * * *